US007562894B2

(12) United States Patent
Krafft

(10) Patent No.: US 7,562,894 B2
(45) Date of Patent: Jul. 21, 2009

(54) GLIDING APPARATUS

(75) Inventor: Bertrand Krafft, Brison Saint-Innocent (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 12/024,426

(22) Filed: Feb. 1, 2008

(65) Prior Publication Data

US 2008/0185819 A1 Aug. 7, 2008

(30) Foreign Application Priority Data

Feb. 2, 2007 (FR) ..... 07 00766

(51) Int. Cl.
*A63C 5/052* (2006.01)

(52) U.S. Cl. ..... 280/609; 280/611; 280/631

(58) Field of Classification Search ..... 280/609, 280/607, 11.3, 611, 617, 618, 620, 626, 628, 280/629, 630, 631, 634
See application file for complete search history.

(56) References Cited

U.S. PATENT DOCUMENTS

| | | | | |
|---|---|---|---|---|
| 3,121,892 | A | 2/1964 | Plumlee | |
| 4,141,570 | A * | 2/1979 | Sudmeier | 280/607 |
| 5,197,752 | A | 3/1993 | Engelbert et al. | |
| 5,286,051 | A * | 2/1994 | Scherubl | 280/607 |
| 5,782,475 | A * | 7/1998 | Balmain | 280/14.22 |
| 5,984,324 | A * | 11/1999 | Wariakois | 280/14.24 |
| 6,000,711 | A * | 12/1999 | Fey et al. | 280/603 |
| 6,283,491 | B1 | 9/2001 | Bush et al. | |
| 6,394,482 | B1 | 5/2002 | Carlson | |
| 7,073,811 | B2 * | 7/2006 | Puget | 280/610 |
| 7,159,875 | B2 * | 1/2007 | Seymour | 280/14.21 |
| 7,178,821 | B2 * | 2/2007 | Miller et al. | 280/624 |

FOREIGN PATENT DOCUMENTS

| | | |
|---|---|---|
| CA | 2 039 342 C | 10/1991 |
| DE | 91 04 587 U1 | 8/1991 |
| FR | 2 660 567 A1 | 10/1991 |
| FR | 2 690 351 A1 | 10/1993 |
| WO | WO-91/12056 A1 | 8/1991 |

* cited by examiner

*Primary Examiner*—Christopher P Ellis
*Assistant Examiner*—John D Walters

(57) ABSTRACT

A pair of gliding boards adapted to be used together by a user, with no connection to one another, for gliding in a gliding direction, the pair of boards including a first board which has an elongated shape extending along a first longitudinal axis and a first arrangement to fasten the user's left foot to the first board along a first fastening axis, the pair of boards also including a second board which has an elongated shape extending along a second longitudinal axis and a second arrangement to fasten the user's right foot to the second board along a second fastening axis. The first fastening axis forms a first angle β1 with the first longitudinal axis, the second fastening axis forms a second angle β2 with the second longitudinal axis, the angle β1 and angle β2 being oriented in the same direction, and at least one of the angles β1 and β2 being non-zero.

18 Claims, 4 Drawing Sheets

GLIDING APPARATUS

CROSS-REFERENCE TO RELATED APPLICATION

This application claims priority under 35 U.S.C. §119 of French Patent Application No. 07 00766, filed on Feb. 2, 2007, the disclosure of which is hereby incorporated by reference thereto in its entirety.

BACKGROUND OF THE INVENTION

1. Field of the Invention

The invention relates to a gliding apparatuses, such as skis. More particularly, the invention relates to gliding apparatuses made of a pair of distinct gliding boards that are each fastened to respective ones of the user's feet.

2. Description of Background and Other Information

Gliding apparatuses of the aforementioned type are generally characterized as skis. Many types of skis are currently used on snow, including alpine skis, cross-country skis, jump skis, short skis, etc. There are also skis adapted for use on water, such as water skis. Skis commonly have an elongated shape extending along a longitudinal axis, and have means for fastening a foot onto the ski. Such fastening means are positioned in a central zone of the ski and ensure that the foot is fastened along the longitudinal axis of the ski. Also common to all skis is their use in gliding in a given direction D, i.e., the gliding axis, which is parallel to or coextensive with the longitudinal axis of the ski. To travel in a straight line, the user keeps each of his skis completely flat while maintaining his weight in the center of the ski. To turn left, the skier shifts his weight to the left side of the ski by pressing down on the left edge; to turn right, the skier shifts his weight to the right edge of the ski. Typically, to make a series of turns, the skier moves successively from one edge to the other by laterally shifting his weight. By using the articulations/joints of the ankles, knees, hips, and spine, the skier can easily modify the position of weight, shifting from front to rear, and vice versa, while keeping his balance. However, the human body is not predisposed to lateral flexing. The ankles, knees, and spine only offer a very small degree of lateral flexion, so that, to shift his weight from left to right, or from right to left, the alpine skier engages his entire body rightward or leftward, respectively. In so doing, the skier becomes laterally unbalanced. As consequence, a pair of ski poles have been necessary to preserve the skier's balance and to enable him to turn more easily at high speed.

In recent years, alpine skis have become shorter. To provide the skier with adequate lift, such skis have become wider at the same time. However, the widening limit for an alpine ski is closely related to the fact that the wider the ski, the more difficult it is to turn it. Indeed, because the skier's foot is positioned, transversely, in the middle of the ski, and because the skier must shift his weight over the inner turning edge, the lever arm, which is substantially equal to half the width, is larger with a wider ski, and the effort required to place the ski on the edge increases. In practice, the use of wide alpine skis is not recommended for small sized users or those who are not physically fit.

SUMMARY OF THE INVENTION

The present invention provides a gliding apparatus that remedies drawbacks of the prior art. In particular, the invention provides a novel gliding apparatus that corresponds better to the human morphology.

In addition, the invention provides a novel gliding apparatus that enables wide gliding boards to be used more easily and to be accessible to a greater number of skiers.

The invention also provides a novel gliding apparatus that provides the user with greater balance, even at low speed.

More particularly, the invention provides a pair of gliding boards adapted to be used together, with no connection to one another, for gliding in a gliding direction, the pair of boards including a first board, which has an elongated shape extending along a first longitudinal axis and a first arrangement for fastening the user's left foot to the first board, along a first fastening axis; the pair of boards also including a second board, which has an elongated shape extending along a second longitudinal axis and a second arrangement for fastening the user's right foot to the second board, along a second fastening axis, the first fastening axis forming a first angle $\beta 1$ with the first longitudinal axis, the second fastening axis forming a second angle $\beta 2$ with the second longitudinal axis, the angle $\beta 1$ and angle $\beta 2$ being oriented in the same direction, and at least one of the angles $\beta 1$ and $\beta 2$ not being zero.

In a particular embodiment, each of the angles $\beta 1$ and $\beta 2$ has a value between 0° and 30°.

In one embodiment of the invention, the angles $\beta 1$ and $\beta 2$ are oriented clockwise from the longitudinal axes of their respective boards.

In another embodiment of the invention, the angles $\beta 1$ and $\beta 2$ are oriented counterclockwise from the longitudinal axes of their respective boards.

Advantageously, the gliding boards according to the invention are wide, even in the waist area of each board, i.e., the zone of each board in which the user's foot is positioned.

In a particular embodiment, the gliding boards according to the invention have offset sidecuts, i.e., the "recess" of the left sidecut and the "recess" of the right sidecut are not at the same longitudinal position. One way to achieve this effect is to offset the right edge entirely with respect to the left edge.

In fact, in one embodiment of the invention, the contour of each of the gliding boards is defined by a closed curved passing by a left shovel point and a right shovel point, both located in the area of the shovel, on the one hand, and by a left tail point and a right tail point, both located in the area of the tail, on the other hand; these points being further defined by the fact that they constitute concavity/convexity inversion points for the contour, and by the fact that in the portion of the contour connecting the left shovel point and the left tail point, i.e., the left sidecut, and in the portion of the contour connecting the right shovel point and the right tail point, i.e., the right sidecut, the contour is always concave. A straight line passing through the left shovel point and the right shovel point forms, together with the first longitudinal axis, a clockwise or counterclockwise angle $\delta s$ that is not equal to 90°, and a straight line passing by the left tail point and the right tail point forms, together with the first longitudinal axis, an angle $\delta t$ oriented in the same direction as the angle $\delta s$, and which is not equal to 90°.

A pair of gliding boards according to the invention can be used on snow or on water.

The mechanisms for fastening the left foot and right foot can include threaded inserts that are anchored in the gliding boards, or a respective interface fixed on each of the gliding boards; each of such interfaces being provided to receive a foot-retaining binding. These fastening mechanisms can also include a device provided to receive the left or right foot. Such devices can also include a strap provided to receive the left or right foot.

While the skier successively moves from one edge to the other by laterally shifting his weight in order to make successive turns with a pair of prior art alpine skis, moving successively from one edge to the other is carried out with front and rear weighting with the gliding apparatus according to the invention. Thus, the articulations of the knees, ankles, and hips work in directions that best suit them morphologically.

The user's feet are not oriented along the axis of the boards, i.e., along the straight gliding axis. They form an angle such that the heels are closer to one of the edges, and such that the toes are closer to the other edge. The angle formed by the gliding axis and the foot axis is between 5° and 30° or between about 5° and about 30°.

In a particular embodiment, the two gliding boards are wide, with a width between 120 mm (millimeters) and 160 mm, or between about 120 mm and about 160 mm, in the area in which the feet are fastened.

Although the gliding boards are wide, they are easy to maneuver. Indeed, due to the positioning of the feet along a non-zero angle, the toes or the heels are always in the vicinity of the inward turning edges. In comparison, a pair of gliding boards according to the invention are much easier to maneuver, and therefore much more accessible for all types of users, than a pair of skis having an equal width at the waist.

BRIEF DESCRIPTION OF DRAWINGS

The invention will be better understood from the description that follows, with reference to the attached drawings, in which.

DETAILED DESCRIPTION OF THE INVENTION

Figure 1:
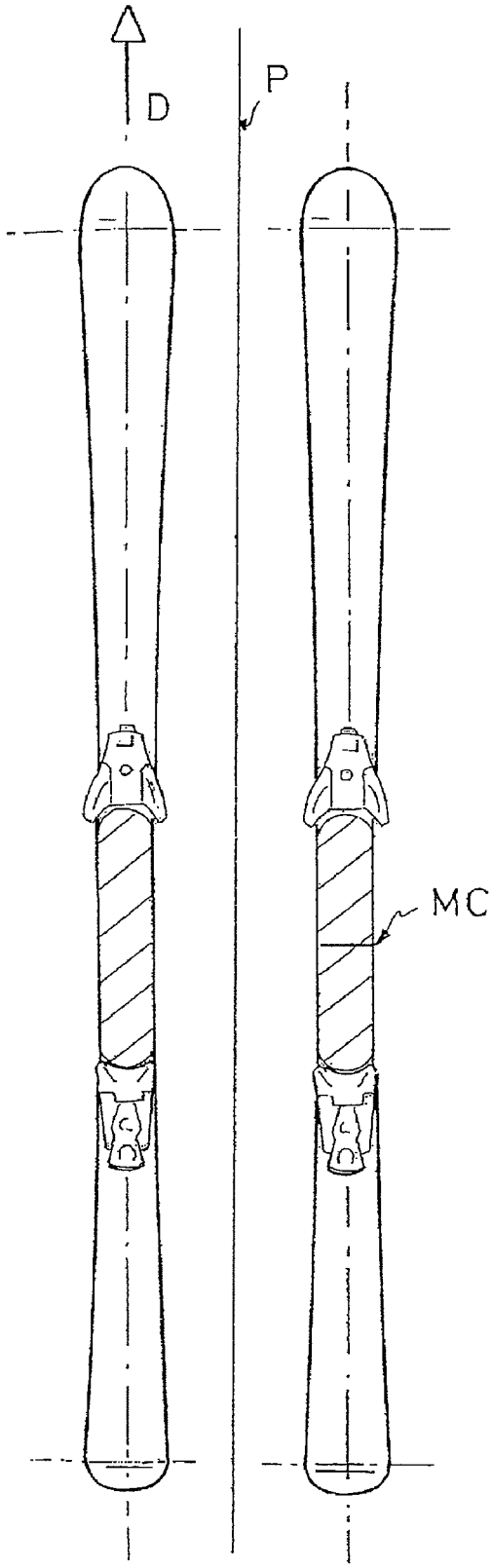
Fig. 1 Prior Art
FIG. 1 is a top view of a pair of skis according to the prior art.

FIG. 1 illustrates a pair of skis according to the prior art. Each of the skis has an elongated shape extending along a longitudinal axis that is parallel to, or coextensive with, the gliding direction D. The contour of each ski is defined as a closed curve having the following characteristics. At the front end, the maximum width line, measured perpendicular to the longitudinal axis, separates the shovel and the body of the ski. At the rear end, the maximum width line, measured perpendicular to the longitudinal axis, separates the tail and the body of the ski. The geometry of the contour of the ski body, i.e., the portion demarcated by the front maximum width line and the rear maximum width line, plays a very important role in the behavior of the ski. The left portion of this contour is referred to as the left sidecut, and the right portion is referred to as the right sidecut. As a general rule, especially for use on-piste, i.e., on groomed trails or slopes, the left and right sidecuts are concave. Furthermore, although so-called asymmetrical skis exist, the left and right sidecuts are most often symmetrical with respect to the longitudinal axis. Moreover, even in the case in which the pair of skis includes a left ski that is different from the right ski, the right and left skis in the pairs of skis known from the prior art are symmetrical with respect to a plane of symmetry P. When the pair of skis lies on the ground, this plane of symmetry P is vertical and contains the gliding direction.

To be used, skis are equipped with boot retaining devices, i.e., bindings, that are fixed to the skis, in the waist area, i.e., in the minimum width zone of the ski. As a general rule, a transverse line, called the "boot centerline" MC is defined for each ski and is located in the area of the minimal width line of the ski. The positioning of the bindings with respect to the ski is such that, when the boot is positioned on the ski, the effective middle point of the boot is in the vicinity of the "boot centerline" MC.

Furthermore, the bindings are positioned such that the user's foot is oriented along the gliding direction of each ski. There could be means for retaining a boot on a ski which have devices enabling the angle of the user's foot to be varied with respect to the longitudinal axis of the ski. However, such devices are designed to provide the skier with greater comfort in the case in which the skier has articular deformations, such as, e.g., when his feet form a particularly wide angle with respect to one another. Moreover, the adjustment of such devices ensures that the position of the right foot is symmetrical with the position of the left foot with respect to the plane of symmetry P.

The ski edges are the lower ridges of the ski along the left and right sidecuts. When making a turn, the user places his weight over the inward turning edges, i.e., the left edge for each of the skis for a left turn and the right edge for a right turn.

Figure 2:
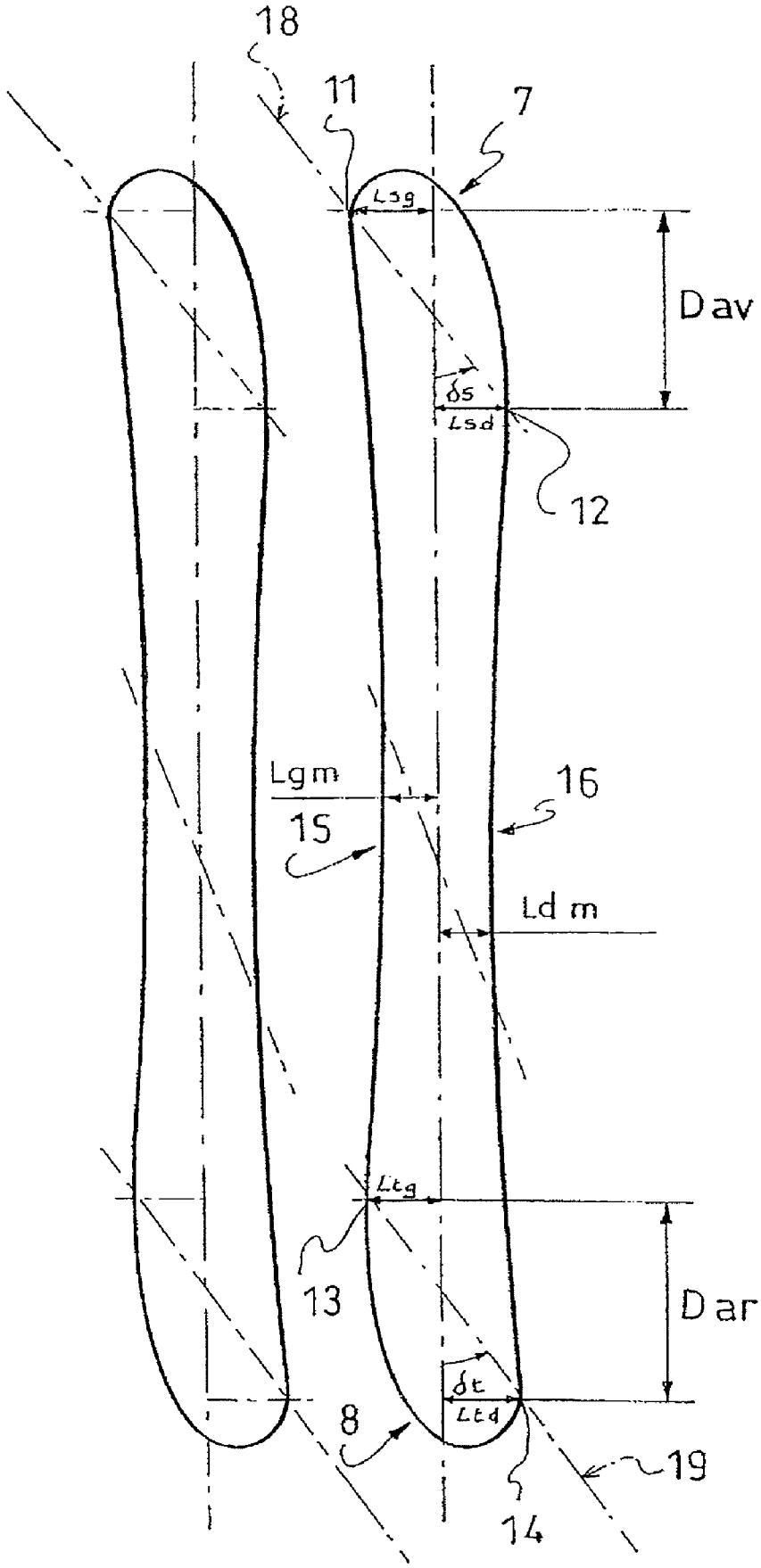
FIG. 2 is a top view of a gliding board of an apparatus according to the invention.

FIG. 2 shows a top view of a gliding board according to a first embodiment of the invention. The geometry of the gliding board contour is defined by a closed curve. This curve passes through at least four inflexion points. Two of these inflexion points are located in the vicinity of the front end of the ski and constitute the left shovel point 11 and the right shovel point 12. Two other inflexion points are located in the vicinity of the rear end of the ski and constitute the left tail point 13 and the right tail point 14. The positioning of these points is such that there is no other inflexion point between the left shovel point 11 and the left tail point 13, on the one hand, and between the right shovel point 12 and the right tail point 14, on the other hand. In other words, between the left shovel point 11 and the left tail point 13, and between the right shovel point 12 and the right tail point 14, respectively, there is no change in the concavity/convexity of the curve. In this case, in the embodiment described in FIG. 2, the curve is always concave between the left shovel point 11 and the left tail point 13, and between the right shovel point 12 and the right tail point 14, respectively.

The portion of the gliding board contour that connects the left shovel point 11 to the left tail point 13 is called the left sidecut 15. The portion of the gliding board contour that connects the right shovel point 12 to the right tail point 14 is called the right sidecut 16. As for most skis adapted for use on snow, the left sidecut and the right sidecut are concave. The concavity of the left and right sidecuts is not necessarily constant along the their respective lengths; however, if the concavity changes to ensure an adequate behavior of the gliding board, it changes uniformly.

The portion of the gliding board contour that connects the left shovel point to the right shovel point demarcates the contour of the shovel 7. The portion of the gliding board contour that connects the left tail point to the right tail point demarcates the contour of the tail 8. The contours of the shovel and tail can have any possible shape.

The front end straight line 18 is that which passes through the left shovel point 11 and right shovel point 12. This straight line 18 forms an angle $\delta s$ with the longitudinal axis. The rear end straight line 19 is that which passes through the left tail point 13 and right tail point 14. The straight line 19 forms an angle $\delta t$ with the longitudinal axis. The angle $\delta s$ and angle $\delta t$ are both different from 90°. These angles can be equal or non-equal. However, these angles are oriented in the same direction. In the embodiment illustrated in FIG. 2, the angle δs is oriented counterclockwise from the longitudinal axis and has a value between 5° and 85°. The angle δt is also oriented counterclockwise and has a value equal to or substantially equal to that of the angle δs.

Because the angles δs and δt are different from 90°, and because they are oriented in the same direction, i.e., clockwise or counterclockwise from the longitudinal axis (or longitudinal vertical plane), the right sidecut 16 is offset with respect to the left sidecut 15. This constitutes a revolution in relation to all of the currently available skis. The front offset Dav of the sidecuts is calculated as a function of the angle δs and as a function of the width of the gliding board. More precisely, the front offset Dav of the sidecuts is equal to the sum of half the width Lsg of the gliding board in the area of the left shovel point 11, and half the width Lsd of the gliding board in the area of the right shovel point 12, the whole being divided by the tangent of the angle δs, where:

$$Dav=(Lsg+Lsd)/\tan \delta s$$

The rear offset Dar of the sidecuts is defined in the same fashion. The rear offset of the sidecuts is equal to the sum of half the width Ltg of the gliding board in the area of the left tail point 13, and half the width Ltd of the right tail point 14, the whole being divided by the tangent of the angle δt, where:

$$Dar=(Ltg+Ltd)/\tan \delta t$$

It is noted that the half width Lsg of the gliding board in the area of the left shovel point 11, and the half width Lsd of the gliding board in the area of the right shovel point 12 are the maximum half widths of the gliding board in the area of its front end, on the left side and on the right side, respectively. Similarly, the half width Ltg of the gliding board in the area of the left tail point 13, and the half width Ltd of the gliding board in the area of the right tail point 14 are the maximum half widths of the gliding board in the area of its rear end, on the left side and on the right side, respectively.

There is a minimum left half width Lgm on the left side of the board, between the maximum half width of the gliding board in the area of its front end and the maximum half width of the gliding board in the area of its rear end. Similarly, there is a minimum right half width Ldm on the right side, between the maximum half width of the gliding board in the area of its front end and the maximum half width of the gliding board in the area of its rear end.

The line where the minimum left half width Lgm is located corresponds to the "recess" of the left sidecut. Similarly, the line where the minimum right half width Ldm is located corresponds to the "recess" of the right sidecut. Longitudinally, the "recess" of the left sidecut is forward of the "recess" of the right sidecut.

In a particular embodiment, the two gliding boards are wide, with a width between 120 mm and 160 mm, or a width between approximately 120 mm and approximately 160 mm, in the area where the feet are fastened, i.e., such as in the area of the bindings. As a general rule, the width in this area is slightly greater than the sum of the minimum left half width Lgm and the minimum right half width Ldm.

In a particular embodiment, the length of each of the gliding boards can be between 900 mm and 1700 mm. Favorable results are achieved with lengths between 1300 mm and 1500 mm.

Figure 3:
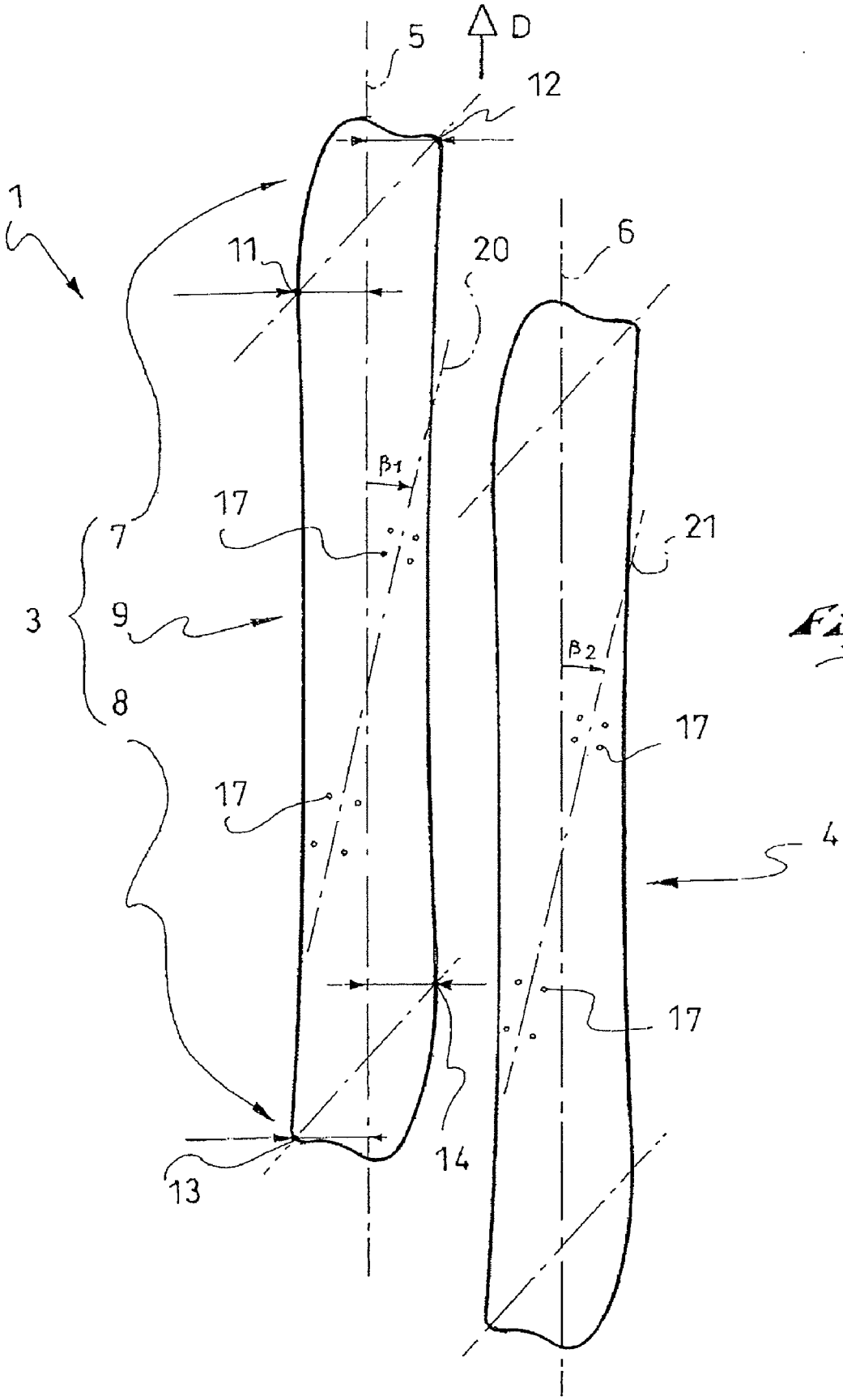
FIG. 3 is a top view of a pair of gliding boards according to a second embodiment of the invention.

FIG. 3 illustrates a pair of gliding boards according to a second embodiment of the invention. This is a pair 1 of gliding boards for a "regular" user. The pair 1 of gliding boards includes a first gliding board 3 adapted to be fixed to the user's left foot, and a second gliding board 4 adapted to be fixed to the user's right foot. The first gliding board 3 has an elongated shape extending along a first longitudinal axis 5, which is parallel to the gliding direction D when the gliding apparatus is in use. It is divided into three main portions, namely, a shovel 7 at the front end of the gliding board 3, a tail 8 at the rear end, and a body 9 between the shovel 7 and the tail 8.

The description of the gliding board illustrated in FIG. 2 applies to the first gliding board shown in FIG. 3, and has not been described to the same extent below. The first gliding board of FIG. 3 distinguishes over the gliding board of FIG. 2 in that the angles δs and δt are equal, and in that the contour of the shovel and contour of the tail are different.

The second gliding board 4 has an elongated shape extending along a second longitudinal axis 6, which is parallel to the gliding direction D when the pair 1 of gliding boards is in use. For the remainder, the second gliding board 4 is identical to the first gliding board 3, and everything to be said hereinafter about the first gliding board 3 is also applicable to the second gliding board 4, unless otherwise specified.

The first gliding board 3 also includes arrangement for fastening the user's left foot to the first board. Such arrangement includes a plurality of threaded inserts fixed within the gliding board. In a particular embodiment, these inserts 17 are put in place during the manufacture of the gliding board. Prior to using the gliding board, it suffices to mount retaining elements, i.e., such as boot-retaining bindings, by means of these inserts. According to the invention, the arrangement for fastening the user's left foot to the first gliding board 3 makes it possible to fasten the user's left foot along a first fastening axis 20 which forms, with the first longitudinal axis 5, a non-zero angle β1 that is oriented clockwise. In practice, the angle β1 is between 0 and 30°, and more particularly between 5° and 30°. In the example illustrated in FIG. 3, the angle β1 is equal to 12°.

Similarly, inserts 17 are also anchored in the second gliding board 4 and enable the bindings to be secured to the board. As for the first gliding board 3, the inserts 17 are positioned such that the user's right foot is fastened to the second gliding board 4 along a second fastening axis 21 which forms, together with the second longitudinal axis 6, a non-zero angle β2 that is oriented clockwise. In practice, the angle β2 is between 0 and 30°, and more particularly between 5° and 30°. In the example illustrated in FIG. 3, the angle β2 is equal to 12°.

The inserts 17 to be used are any that can be used to receive any particular boot retaining means or binding. In particular, one can use safety bindings that are commonly used with alpine skis. One can also call for various bindings, including bindings for telemark skis, Nordic skis, alpine skis, cross-country skis, as well as central-engagement bindings, step-in bindings, and even non-releasable bindings in the case in which the gliding boards are short in length.

FIG. 3 illustrates the pair 1 of gliding boards for a "regular user" in position of use, i.e., respecting the relative position of the first and second gliding board with respect to one another, when the gliding board is in a straight line.

When a user instinctively takes a forward split position, i.e., with one foot in front of the other, the user will naturally decide to either keep the right foot in the back more often, or keep the left foot in the back more often. The preferred position is the one in which the user is most comfortable. The user is called a "regular" user when his left foot is in the back, and a "goofy" user when his right foot is in front.

The "regular" pair 1 of gliding boards is particularly adapted for "regular" users.

When gliding in a straight line with a pair of gliding boards according to invention, the "regular" user keeps his feet separated from one another by a distance of his choosing. The feet are offset with respect to one another as a function of a number of factors, for example, the user's height, his speed, his skill level, and the local piste conditions, i.e., the conditions of the groomed trail or slope where the user will be skiing.

To turn the pair of gliding boards leftward during practice, the user must shift his body rearward, take support on his heels and, in order to maintain his balance, position the right foot far behind the left foot. The user is then said to be in the "back" position; and a leftward turn for a "regular" user is called a "back" turn.

To turn rightward, i.e., to make a "front" turn, the user shifts the weight of his body toward the toes. This movement involves a reduction in the spacing between the feet; however, the "regular" position is still effective, i.e., the left foot remains in front of the right foot.

Figure 4:
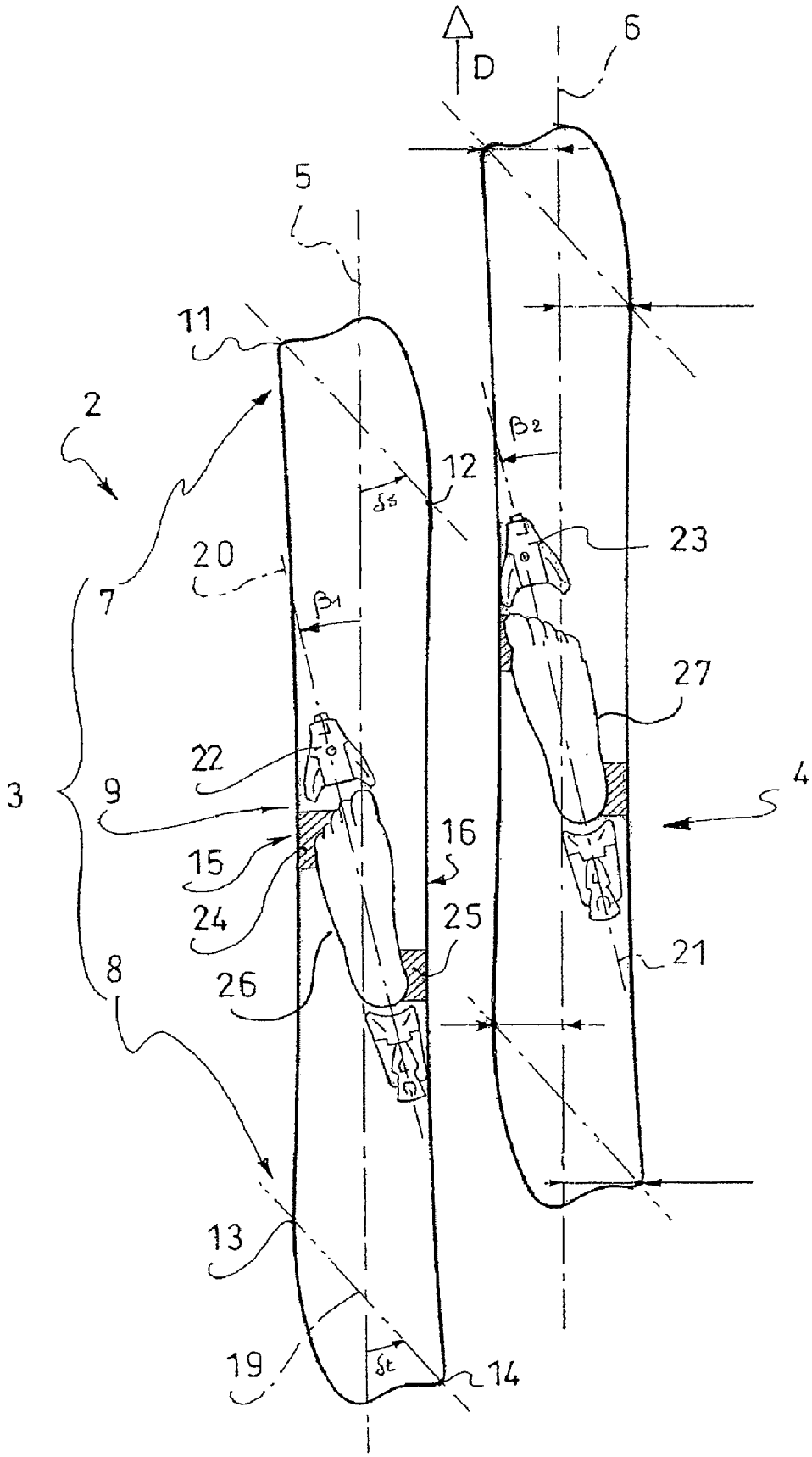
FIG. 4 is a view of a pair of gliding boards according to a third embodiment of the invention.

FIG. 4 illustrates a gliding apparatus according to a third embodiment of the invention. This is a gliding apparatus 2 for a "goofy" user.

The "goofy" gliding apparatus 2 includes a pair of gliding boards, each being equipped with a boot-retaining device or binding. In particular, the gliding apparatus 2 includes a first gliding board 3 adapted to be fixed to the user's left foot, and a second gliding board 4 adapted to be fixed to the user's right foot. The first gliding board 3 and the second gliding board 4 have an elongated shape extending along a first longitudinal axis 5 and a second longitudinal axis 6, respectively, which are parallel to the gliding direction D when the gliding apparatus is in use. The gliding boards are divided into three main portions, namely, a shovel 7 at the front end of the gliding board 3, a tail 8 at the rear end, and a body 9 between the shovel 7 and the tail 8.

The first 3 and second 4 gliding boards are identical. Furthermore, in the example illustrated in FIG. 4, they are symmetrical with respect to the gliding boards shown in FIG. 3.

The geometry of the gliding board contour is defined by a closed curve. This curve passes through at least four inflexion points. Two of the inflexion points are located in the vicinity of the front end of the ski and constitute the left shovel point 11 and the right shovel point 12. Two other inflexion points are located in the vicinity of the rear end of the ski and constitute the left tail point 13 and the right tail point 14. The positioning of these points is such that there is no other inflexion point between the left shovel point 11 and the left tail point 13, on the one hand, and between the right shovel point 12 and the right tail point 14, on the other hand. In this case, between the left shovel point 11 and the left tail point 13, and between the right shovel point 12 and the right tail point 14, the left sidecut 15 and the right sidecut 16, respectively, are always concave.

The contour of the shovel 7, i.e., the portion of the contour that is demarcated by the left shovel point 11 and the right shovel point 12 has another inflexion point located between the two preceding points.

The contour of the tail 8 has a shape similar to that of the contour of the shovel 7.

The front end straight line 18 passing via the left shovel point 11 and the right shovel point 12 forms, together with the longitudinal axis, an angle $\delta s$ comprised between 20° and 60°. The rear end straight line 19 passing via the left tail point 13 and the right tail point 14 forms, together with the longitudinal axis, an angle $\delta t$ comprised between 20° and 60°. Favorable results are obtained with the angles $\delta s$ and $\delta t$ being equal to 40° and oriented counterclockwise.

The left retaining device or binding 22 and right retaining device or binding 23 are fixed to the first gliding board 3 and to the second gliding board 4, respectively, such that the user's left foot and right foot form an angle $\beta 1$ and an angle $\beta 2$, respectively, with the first longitudinal axis 5 and second longitudinal axis 6, respectively. The angles $\beta 1$ and $\beta 2$ are non-zero and are both oriented counterclockwise. The angles $\beta 1$ and $\beta 2$ are equal and comprised between 5° and 30°. Favorable results are obtained with the angles $\beta 1$ and $\beta 2$ being equal to 12°. When the angles $\beta 1$ and $\beta 2$ are equal, one ensures, during practice, that the left foot and right foot remain parallel to one another. However, the angles $\beta 1$ and $\beta 2$ being equal is in no way a limiting characteristic of the invention, which encompasses gliding apparatuses in which the angles $\beta 1$ and $\beta 2$ are not equal. In such a case, the feet are no longer exactly parallel to each other. This choice is dependent upon reasons of comfort or reasons of performance.

FIG. 4 shows the user's left 26 and right 27 footprints. The front of the left foot and the front of the right foot are in the vicinity of the left edge of the first gliding board and in the vicinity of the left edge of the second gliding board, respectively. The rear of the left foot and the rear of the right foot are in the vicinity of the right edge of the first gliding board and in the vicinity of the right edge of the second gliding board, respectively.

The "goofy" gliding apparatus 2 is particularly adapted for "goofy" users. It is used as follows: when the user glides in a straight line with a "goofy" gliding apparatus, he keeps the right foot in front of the left foot, both feet being offset with respect to one another as a function of a number of factors, for example, the user's height, his speed, his skill level, as well as the local piste conditions, i.e., the conditions of the local trails where he intends to ski. To initiate a left turn, the user must position his weight on the inward turning edges, i.e., the left edge of each of the gliding boards. To do so, he shifts the weight of his body forward and, consequently, shifts his weight to the toes. The user bends forward and reduces the offset between the right foot and the left foot. For the "goofy" user, the left turn is a "front" turn.

To initiate a right turn, the user must position his weight on the inward turning edges, i.e., the edge of each of the gliding boards in this case. To do so, the user shifts the weight of his body rearward and, consequently, shifts his weight to the heels. The user must increase the offset between the right foot and the left foot to keep his balance.

The body shifting movement to make a "front" or "back" turn is much easier as the shoulders are oriented along the gliding axis, and not perpendicular thereto, as is the case in alpine skiing.

When in the "front" position, the user puts the weight of his body on the two "front" support zones 24, each of them being fixed on one of the gliding boards. For the "regular" gliding apparatus 1, the "front" support zones 24 are located in the vicinity of the right edge, whereas they are located in the vicinity of the left edge for a "goofy" gliding apparatus 2.

When in the "rear" position, the user positions the weight of his body on the two "rear" support zones 25, each of them being fixed on one of the gliding boards. For the "regular" gliding apparatus 1, the "rear" support zones 25 are located in the vicinity of the left edge, whereas they are located in the vicinity of the right edge for a "goofy" gliding apparatus 2.

Longitudinally, the "front" 24 and "rear" 25 support zones are located in the vicinity of the left Lgm and right Ldm minimum half width lines. Moreover, if the "front" 24 and "rear" 25 support zones are connected to one another by a straight line, this straight line forms, together with the longitudinal axis, an angle that is close to the angle δs and to the angle δt.

The invention is not limited to the several embodiments described herein by way of examples and encompasses any equivalent embodiment.

LIST OF ELEMENTS

1—"regular" pair of gliding boards
2—"goofy" gliding apparatus
3—first gliding board
4—second gliding board
5—first longitudinal axis
6—second longitudinal axis
7—shovel
8—tail
9—body of the gliding board
10—boot centerline
11—left shovel point
12—right shovel point
13—left tail point
14—right tail point
15—left sidecut
16—right sidecut
17—threaded insert
18—front end straight line
19—rear end straight line
20—first fastening axis
21—second fastening axis
22—left binding
23—right binding
24—"front" support zone
25—"rear" support zone
26—left footprint
27—right footprint

The invention claimed is:

1. A pair of gliding boards adapted to be used together by a user, with no connection from one of said pair to another of said pair during use of the pair of gliding boards for gliding in a gliding direction, said pair of gliding boards comprising:

a first gliding board having an elongated shape extending along a first longitudinal axis, said first gliding board having a first arrangement for fastening the user's left foot to said first gliding board along a first fastening axis;

a second gliding board having an elongated shape extending along a second longitudinal axis, said second gliding board having a second arrangement for fastening the user's right foot to said second gliding board along a second fastening axis;

the first fastening axis forming a first angle β1 with the first longitudinal axis;

the second fastening axis forming a second angle β2 with the second longitudinal axis;

the angles β1 and β2 extending from respective ones of the first and second longitudinal axes in the same direction;

at least one of the angles β1 and β2 is non-zero;

the first gliding board having an outer periphery defined by a closed curve passing through a left shovel point, a right shovel point, a left tail point, and a right tail point;

each of said points constituting a concavity/convexity inversion point of said contour;

a portion of the contour connecting the left shovel point and the left tail point being a left sidecut, said left sidecut being concave;

a portion of the contour connecting the right shovel point and the right tail point being a right sidecut, said right sidecut being concave;

a straight line passing through the left shovel point and the right shovel point forming, together with said first longitudinal axis, a clockwise or counterclockwise angle δs not equal to 90°;

a straight line passing through the left tail point and the right tail point forming, together with said first longitudinal axis, an angle δt oriented in the same clockwise or counterclockwise direction as the angle δs, said angle δt not being equal to 90°.

2. A pair of gliding boards according to claim 1, wherein: the angle β1 and angle β2 have a value between 0° and 30°.

3. A pair of gliding boards according to claim 1, wherein: the angle β1 extends clockwise from the first longitudinal axis, and angle β2 extends clockwise from the second longitudinal axis.

4. A pair of gliding boards according to claim 1, wherein: the angle β1 extends counterclockwise from the first longitudinal axis, and angle β2 extends counterclockwise from the second longitudinal axis.

5. A pair of gliding boards according to claim 1, wherein: the second gliding board has an outer periphery defined by a closed curve passing through a left shovel point, a right shovel point, a left tail point, and a right tail point;

each of said points constitutes a concavity/convexity inversion point of said contour;

a portion of the contour connecting the left shovel point and the left tail point is a left sidecut, said left sidecut being concave;

a portion of the contour connecting the right shovel point and the right tail point is a right sidecut, said right sidecut being concave;

a straight line passing through the left shovel point and the right shovel point forms, together with said second longitudinal axis, a clockwise or counterclockwise angle δs not equal to 90°;

a straight line passing through the left tail point and the right tail point forms, together with said second longitudinal axis, an angle δt oriented in the same clockwise or counterclockwise direction as the angle δs, said angle δt not being equal to 90°.

6. A pair of gliding boards according to claim 1, wherein: each said arrangement for fastening the left foot and the right foot includes a plurality of threaded inserts.

7. A pair of gliding boards according to claim 1, wherein: each said arrangement for fastening the left foot and right foot includes an interface fixed on each of said first and second gliding boards; said interface being provided to receive a binding for retaining a sports boot.

8. A pair of gliding boards according to claim 1, wherein: each said arrangement for fastening the left foot on said first gliding board and said arrangement for fastening the right foot on the second gliding board includes a fitting device provided to receive the left foot and right foot, respectively.

9. A pair of gliding boards according to claim 1, wherein: each said arrangement for fastening the left foot on said first gliding board and said arrangement for fastening the right foot on the second gliding board includes a strap provided to receive the left foot and right foot, respectively.

10. A pair of gliding boards according to claim 1, wherein: said first and second gliding boards are constructed and arranged for gliding on snow.

11. A pair of gliding boards according to claim 1, wherein: said first and second gliding boards are constructed and arranged for gliding on water.

12. A pair of gliding boards according to claim 1, wherein: both the angle δs and the angle δt are between 5° and 85°.

13. A pair of gliding boards according to claim 1, wherein: the angle δs and the angle δt are substantially equal.

14. A pair of gliding boards according to claim 12, wherein: the angle δs and the angle δt are substantially equal.

15. A pair of gliding boards according to claim 5, wherein: the angles δs and the angles δt are between 5° and 85°.

16. A pair of gliding boards according to claim 5, wherein: the angles δs and the angles δt are substantially equal.

17. A pair of gliding boards according to claim 15, wherein: the angles δs and the angles δt are substantially equal.

18. A gliding apparatus comprising:

a pair of gliding boards adapted to be used together by a user, with no connection from one of said pair to another of said pair during use of the pair of gliding boards for gliding in a gliding direction, said pair of gliding boards comprising:

a first gliding board having an elongated shape extending along a first longitudinal axis, said first gliding board having a first arrangement for fastening the user's left foot to said first gliding board along a first fastening axis;

a second gliding board having an elongated shape extending along a second longitudinal axis, said second gliding board having a second arrangement for fastening the user's right foot to said second gliding board along a second fastening axis;

the first fastening axis forming a first angle β1 with the first longitudinal axis;

the second fastening axis forming a second angle β2 with the second longitudinal axis;

the angles β1 and β2 extending from respective ones of the first and second longitudinal axes in the same direction;

at least one of the angles β1 and β2 is non-zero;

the first gliding board having an outer periphery defined by a closed curve passing through a left shovel point, a right shovel point, a left tail point, and a right tail point;

each of said points constituting a concavity/convexity inversion point of said contour;

a portion of the contour connecting the left shovel point and the left tail point being a left sidecut, said left sidecut being concave;

a portion of the contour connecting the right shovel point and the right tail point being a right sidecut, said right sidecut being concave;

a straight line passing through the left shovel point and the right shovel point forming, together with said first longitudinal axis, a clockwise or counterclockwise angle δs not equal to 90°;

a straight line passing through the left tail point and the right tail point forming, together with said first longitudinal axis, an angle δt oriented in the same clockwise or counterclockwise direction as the angle δs, said angle δt not being equal to 90°; and a pair of boot-retaining devices, each of said pair of retaining devices being adapted to be fixed on a respective one of said first and second gliding boards.

* * * * *